US007800571B2

(12) United States Patent
Leo et al.

(10) Patent No.: US 7,800,571 B2
(45) Date of Patent: Sep. 21, 2010

(54) DARK RING OF A MICRODISPLAY AND ITS DRIVING METHOD

(75) Inventors: Hon-Yuan Leo, Hsinhua (TW); Yung-Yuan Ho, Hsinhua (TW); Yen-Chen Chen, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 1050 days.

(21) Appl. No.: 10/983,228

(22) Filed: Nov. 8, 2004

(65) Prior Publication Data

US 2006/0114203 A1 Jun. 1, 2006

(51) Int. Cl.
*G09G 3/36* (2006.01)

(52) U.S. Cl. ..... 345/96; 345/87; 345/54; 345/103

(58) Field of Classification Search ..... 345/84–103, 345/96, 59

See application file for complete search history.

(56) References Cited

U.S. PATENT DOCUMENTS

| | | | | |
|---|---|---|---|---|
| 5,642,128 | A * | 6/1997 | Inoue | 345/96 |
| 6,791,521 | B2 * | 9/2004 | Isami et al. | 345/89 |
| 7,042,430 | B2 * | 5/2006 | Isami et al. | 345/89 |
| 2002/0097359 | A1 * | 7/2002 | Chuang | 349/123 |

* cited by examiner

*Primary Examiner*—Amare Mengistu
*Assistant Examiner*—Robert R Rainey
(74) *Attorney, Agent, or Firm*—Stout, Uxa, Buyan & Mullins, LLP

(57) ABSTRACT

A method for driving a dark ring of a liquid-crystal-on-silicon (LCOS) display is provided to prevent the fringe effect (bright lines) due to the constant voltage difference between the dark ring and the adjoining pixels within the LCOS display. A dark ring is divided into a plurality of portions. The polarity of each portion is controlled in accordance with the polarity of the adjoining pixels within the LCOS display and the scan direction of gate drivers such that the polarity inversion for each portion will coincide with that for the adjoining pixels within the LCOS display so as to avoid the fringe effect (bright lines).

18 Claims, 4 Drawing Sheets

| Scan direction (UD) for gate drivers | Polarity (POL) of fringing pixels | Polarity of dark ring up | Polarity of dark ring down |
|---|---|---|---|
| top → bottom | P → N | P → N | N → P |
| top → bottom | N → P | N → P | P → N |
| bottom → top | P → N | N → P | P → N |
| bottom → top | N → P | P → N | N → P |

DARK RING OF A MICRODISPLAY AND ITS DRIVING METHOD

BACKGROUND OF THE INVENTION

1. Field of the Invention

The invention relates to a dark ring of a microdisplay and its driving method, in order to prevent the fringe effect occurred between the dark ring and the adjoining pixels within the microdisplay such as liquid-crystal-on-silicon (LCOS) display.

2. Discription of the Prior Art

LCOS display is one of the most popular microdisplays that are broadly adopted in large-sized TV. Because of mechanical and process limitations of the LCOS display, it is necessary to place a dark ring 110 in peripheral of the LCOS display 100 by using a top metal layer, as shown in FIG. 1.

Referring to FIG. 2, in a normally-white mode, there are two voltages, $V_{\tau 1}$ and $V_{\tau 10}$, at which liquid crystal contained within pixels will be biased to obtain a zero transmission rate. It suggests we can bias the liquid crystal at either $V_{\tau 1}$ or $V_{\tau 10}$ to show an all-black image. But the liquid crystal cannot be biased by DC voltages for a long time to avoid undesired deformation. Therefore, the dark ring is required to alternately bias at voltage $V_{\tau 1}$ and $V_{\tau 10}$ on a frame basis. Usually, it is called negative and positive polarity when biased at $V_{\tau 1}$ and $V_{\tau 10}$.

In the normally-white mode, when the LCOS display shows an all-black image with all pixels within the LCOS display changing from negative to positive polarity (that is, in case of frame inversion) and with gate drivers of the LCOS display scanning from top to bottom, the voltage of the dark ring will also change from $V_{\tau 1}$ to $V_{\tau 10}$ at time $t_0$ when activating the topmost scan line of the LCOS display. In this case, data voltages for the adjoining pixels on each scan line (from top to bottom) within the LCOS display will sequentially change from $V_{\tau 1}$ to $V_{\tau 10}$ at time $t_0$, $t_1$, and $t_n$. It means there will be a constant voltage difference between the dark ring and the adjoining pixels on the lower scan lines within the LCOS display for almost a whole frame period, and the fringe effect (bright lines) between the dark ring and the adjoining pixels on the lower scan lines within the LCOS display will occur due to the constant voltage difference and decrease the quality of the image.

This also applies when the LCOS display shows an all-black image with all pixels within the LCOS display changing from negative to positive polarity (that is, in case of frame inversion) and with gate drivers of the LCOS display scanning from bottom to top. Furthermore, this also applies when the LCOS display is performing line inversion or dot inversion.

Therefore, there is a need to provide a new dark ring of the LCOS display and its driving method to prevent the fringe effect and to increase the quality of images.

SUMMARY OF THE INVENTION

One object of the present invention is to provide a method for driving a dark ring of a microdisplay, more particularly of an LCOS display, in order to prevent the fringe effect (bright lines) due to a constant voltage difference between the dark ring and the adjoining pixels on the lower/upper scan lines of the microdisplay. The present invention divides the dark ring into a plurality of portions and respectively adjusts the polarity of each portion in accordance with the polarity of the adjoining pixels within the microdisplay and the scan direction of gate drivers in order to eliminate the voltage difference.

Another object of the present invention is to increase the quality of images on a LCOS display without changing the manufacturing process. In accordance with the invention, we can adopt redundant pixels in side peripherals of the LCOS display area as the dark ring and eliminate the fringe effect (bright lines) by applying data voltages of alternate polarity to the redundant pixels in accordance with the polarity of the adjoining pixels of the LCOS display and the scan direction of gate drivers.

DESCRIPTION OF THE PREFERRED EMBODIMENT

To eliminate the fringe effect (bright lines) due to the constant voltage difference between the dark ring and the adjoining pixels on the lower/upper scan lines within the LCOS display, we have to make the polarity inversion for each portion of the dark ring in peripheral of the LCOS display coincide with that for the adjoining pixels within the LCOS display. To achieve the above, the dark ring may be divided into several portions, with each portion electrically separated from the other. Therefore, we can control the polarity of each portion in accordance with the polarity of the adjoining pixels within the LCOS display and the scan direction of gate drivers, such that the polarity inversion for each portion would coincide with that for the adjoining pixels within the LCOS display.

Figure 1:
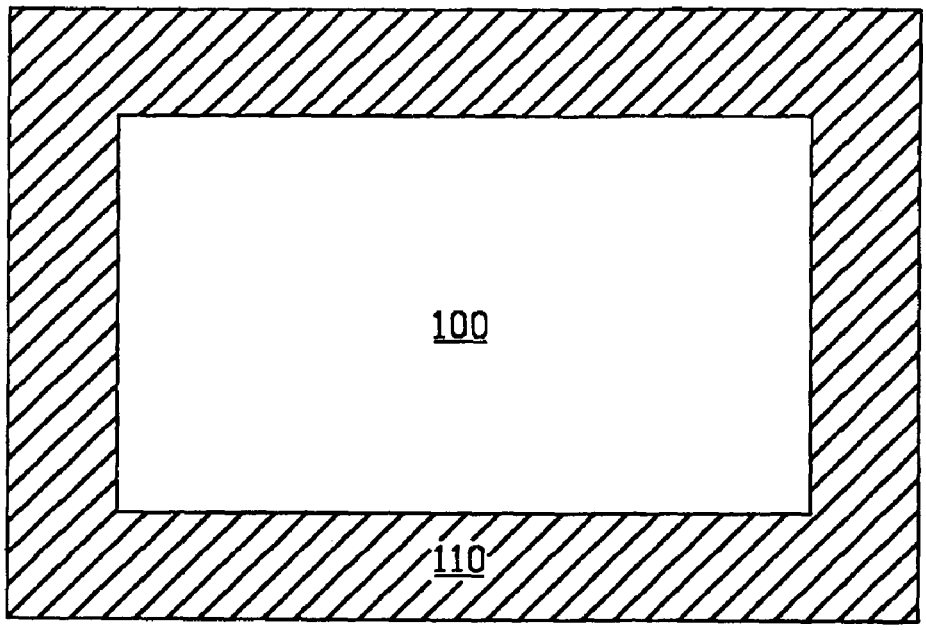
FIG.1(Prior Art)
FIG. 1 is a conventional LCOS display with a dark ring.
Figure 2:
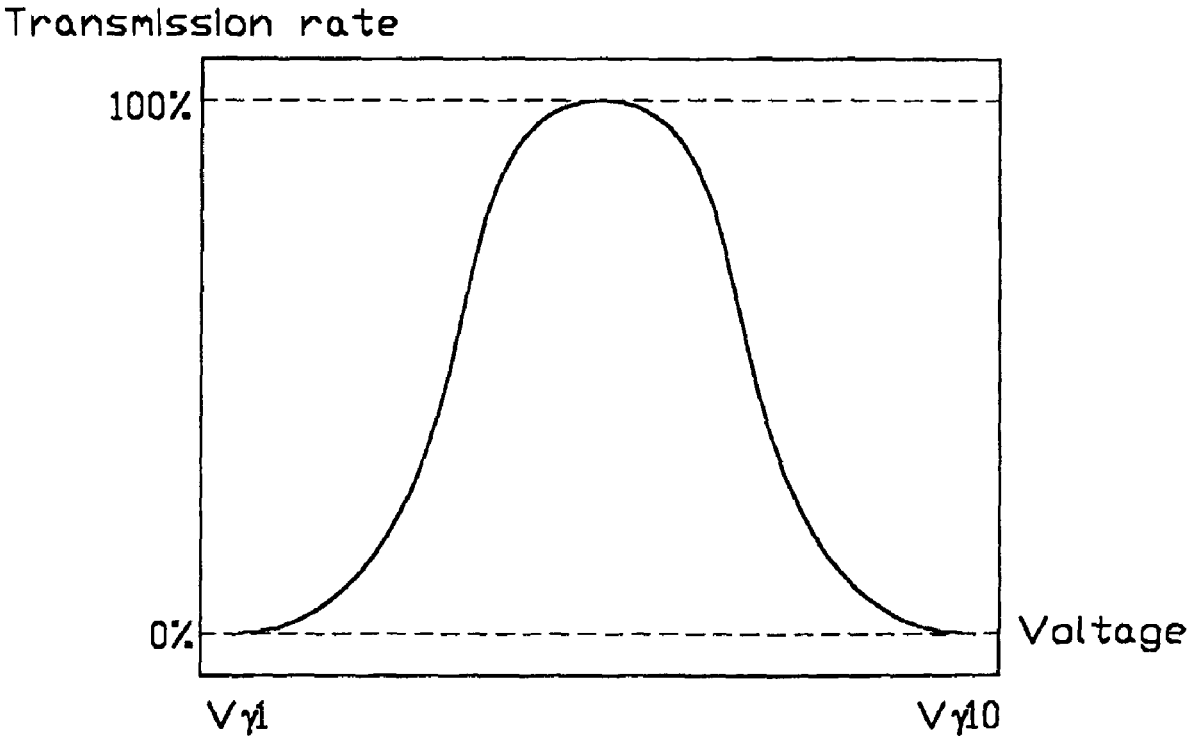
FIG.2(Prior Art)
FIG. 2 illustrates the transmission rate for normally-white liquid crystal when biased at different voltages.
Figures 3, 4:
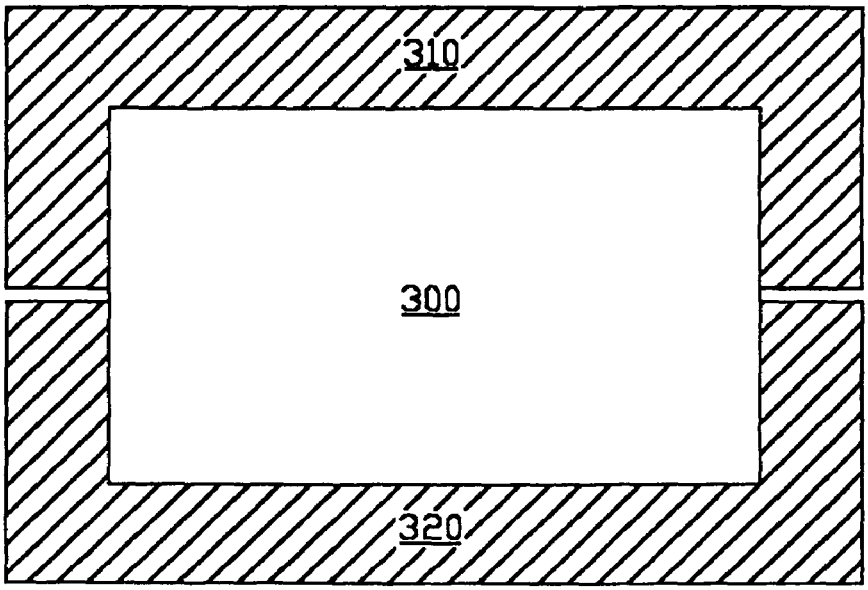
FIG. 3 is a diagram of an embodiment of the present invention.
FIG. 4 shows the polarity inversion for the LCOS display, in case of frame inversion, compared to that for each portion of the dark ring in FIG. 3.

In a preferred embodiment, the dark ring can be divided into two portions, as shown in FIG. 3, that is, a dark ring up 310 and a dark ring down 320. The dark ring up 310 includes the upper half of the dark ring, while the dark ring down 320 includes the lower half of the dark ring. In this case, both of the dark ring up 310 and dark ring down 320 may be implemented by a top metal layer. Further, there is no electrical connection between the dark ring up 310 and the dark ring down 320.

According to the scan direction of gate drivers and the polarity, negative or positive, of the adjoining pixels within the LCOS display, the voltages of the dark ring up 310 and the dark ring down 320 are respectively determined by controlling the polarity inversion for each of the dark ring up 310 and dark ring down 320 to coincide with that of the adjoining pixels within the LCOS display to eliminate the fringe effect (bright lines).

Referring to FIG. 4, the polarity inversion for the dark ring up 310 and that for the dark ring down 320 are reversed to halve the duration for the constant voltage difference occurred between the black ring down 320 and the adjoining pixels on the bottom scan lines can within the LCOS display. In case of frame inversion, when the scan direction of gate drivers is from top to bottom and the polarity of the adjoining pixels within the LCOS display change from positive to negative polarity, the polarity for the dark ring up 310 also changes from positive to negative polarity to coincide with the polarity inversion for the topmost scan line, while the polarity of the dark ring down 320 simultaneously changes from negative to positive. From this, the duration for the constant voltage difference can be halved and the fringe effect (bright lines) due to the constant voltage difference can be reduced accordingly.

This also applies to situations when the scan direction of gate drivers is from top to bottom and the polarity of the adjoining pixels within the LCOS display changes from negative to positive polarity, when the scan direction of gate drivers is from bottom to top and the polarity of the adjoining pixels within the LCOS display changes from positive to negative polarity, and when the scan direction of gate drivers is from bottom to top and the polarity of the adjoining pixels within the LCOS display changes from negative to positive polarity.

Figure 5:
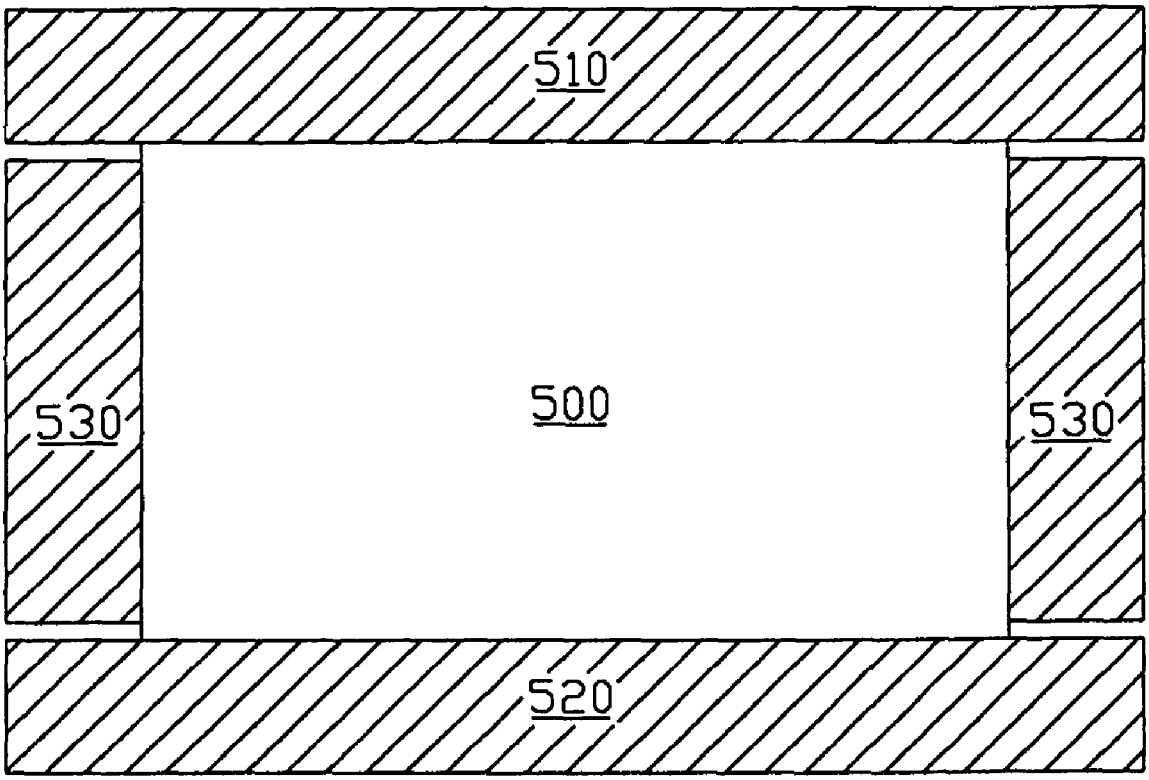
FIG. 5 is a diagram of another embodiment of the present invention.

In another preferred embodiment, the dark ring includes a dark ring up 510, a dark ring down 520 and two dark ring sides 530, as shown in FIG. 5. The dark ring up 510 is disposed in a top peripheral of the LCOS display area 500. The dark ring down 520 is disposed in a bottom peripheral of the LCOS display area 500. The dark ring sides 530 are disposed in side peripherals of the LCOS display area 500. The dark ring up 510 and dark ring down 520 are implemented by a top metal layer, while the dark ring sides 530 are implemented by redundant pixels in side peripherals of the LCOS display area 500, as shown in FIG. 6.

Figure 6:
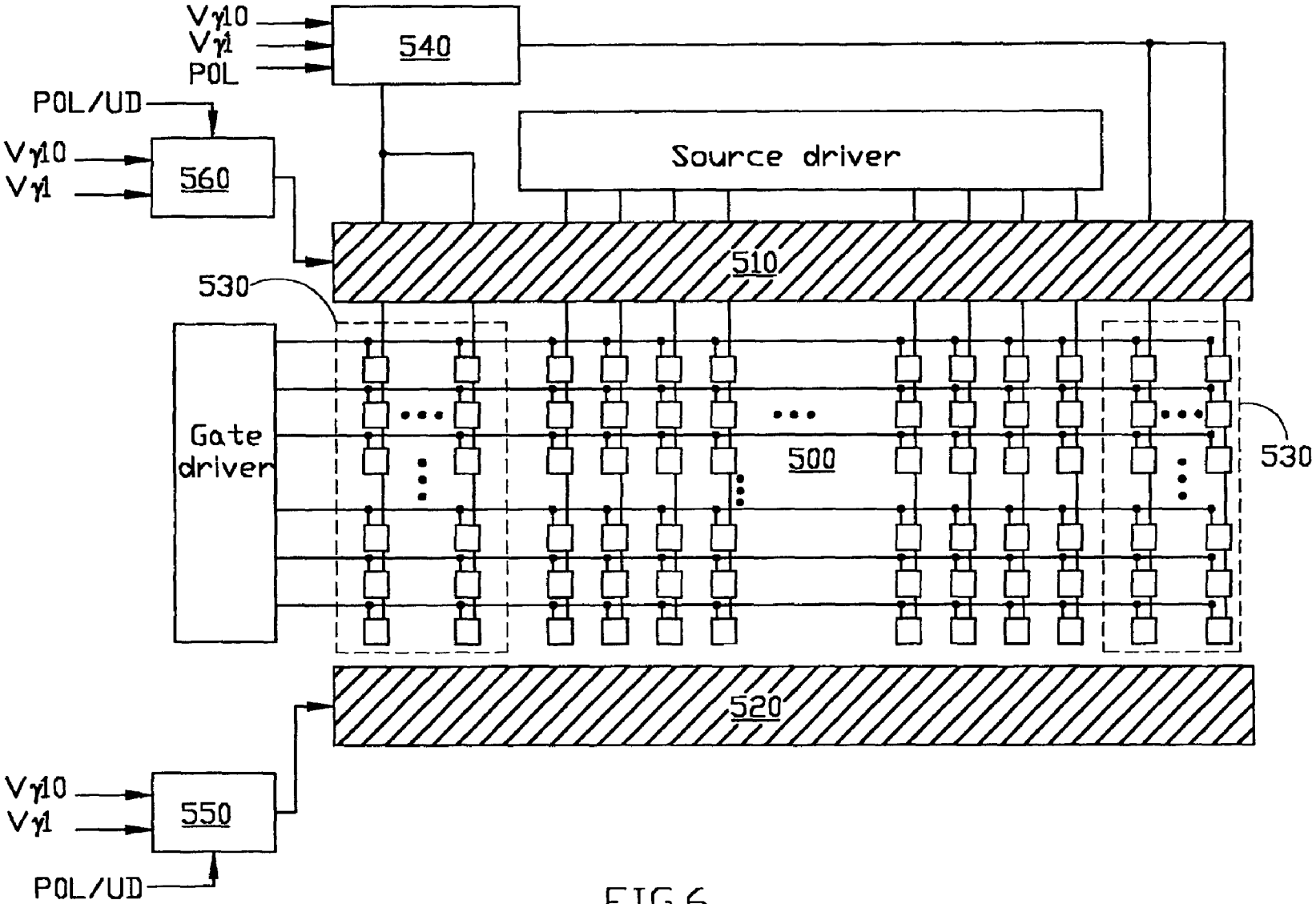
FIG. 6 shows a circuit implementation of FIG. 5.

Referring to FIG. 6, a logic circuit including a logic up 560, a logic down 550 and a logic side 540 is provided to control the dark ring up 510, the dark ring down 520 and the dark ring sides 530 respectively by controlling the polarity of the dark ring up 510, the dark ring down 520 and the dark ring sides 530 in accordance with the polarity of the adjoining pixels within the LCOS display area 500 and the scan direction of gate drivers.

Each of the logic up 560, the logic down 550 and the logic side 540 respectively includes a plurality of inputs. The inputs include $V_{\tau 1}$, $V_{\tau 10}$, POL and UD, wherein $V_{\tau 1}$ refers to a voltage of negative polarity, $V_{\tau 10}$ refers to a voltage of positive polarity, POL refers to the polarity of the adjoining pixels within the LCOS display area 500, that is, negative or positive polarity, and UD refers to the scan direction of gate drivers, that is, from top to bottom or from bottom to top.

As shown in FIG. 6, the polarity inversion for the adjoining pixels within the LCOS display area 500 compared to that for each portion of the dark ring is illustrated below. Also, as mentioned above, the dark ring up 510 and the dark ring down 520 are implemented by a top metal layer, and the dark ring sides 530 are implemented by redundant pixels in side peripherals of the LCOS display area 500. In this case, the polarity inversion for the dark ring up 510 will coincide with that for the adjoining pixels on the topmost scan line, the polarity inversion for the dark ring down 52 will coincide with that for the adjoining pixels on the bottommost scan line, and the polarity inversion for the redundant pixels on each scan line of the dark ring sides 530 will coincide with that for the adjoining pixels on the same scan line within the LCOS display area 500. From this, the duration for the constant voltage difference can be further reduced to within a scan line period, and the fringe effect (bright lines) due to the constant voltage difference can be further reduced.

For example, referring to FIG. 4, wnen the scan direction of gate drivers is from top to bottom and the polarity of all pixels change from positive to negative polarity (in case of frame inversion), the polarity of the dark ring up 510 also changes from positive to negative polarity synchronously with the topmost scan line within the LCOS display area 500 to coincide with the polarity inversion for the adjoining pixels on the topmost scan line within the LCOS display area 500. Further, the polarity of the dark ring down 520 will change from positive to negative polarity synchronously with the bottommost scan line within the LCOS display area 500 to coincide with the polarity inversion for the adjoining pixels on the bottommost scan line within the LCOS display area 500. Further, the polarity of the redundant pixels (adjoining pixels) on each scan line of the dark ring sides 530 will change from positive to negative polarity synchronously with the same scan line within the LCOS display area 500 to coincide with the polarity inversion for the adjoining pixels on the same scan line within the LCOS display area 500. From this, the polarity of the dark ring will immediately follow that of the adjoining pixels within the LCOS display area 500, and the fringe effect (bright lines) due to the constant voltage difference will be greatly eliminated.

This also applies to situations when the scan direction of gate drivers is from top to bottom and the polarity of the adjoining pixels within the LCOS display area 500 changes from negative to positive polarity, when the scan direction of gate drivers is from bottom to top and the polarity of the adjoining pixels within the LCOS display area 500 changes from positive to negative polarity, and when the scan direction of the gate drivers is from bottom to top and the polarity of the adjoining pixels within the LCOS display area 500 changes from negative to positive polarity.

The foregoing is offered primarily for purpose of illustration. It will be readily apparent to those skilled in the art that the operating conditions, materials, procedural steps and other parameters of the system described herein may be further modified or substituted in various ways without departing from the spirit and scope of the invention.

What is claimed is:

1. A method for driving a dark ring of a microdisplay during a frame period, said microdisplay including a display area having a plurality of pixels for displaying an image, comprising:

providing a dark ring surrounding the plurality of pixels of the display area, said dark ring including a dark ring up metal and a dark ring down metal, said dark ring up metal and said dark ring down metal being electrically isolated from each other;

controlling said dark ring up metal to show an all-black image during a frame period firstly;

controlling the pixels of the display area to show the image during the frame period secondly; and controlling said dark ring down metal to show an all-black image during the frame period lastly;

wherein the polarity for each of said dark ring up metal and said dark ring down metal is adjusted in accordance with the polarity of adjoining pixels within the microdisplay and the scan direction of gate drivers to coincide with that for adjoining pixels within the display area;

wherein the polarity of the dark ring up metal changes from positive to negative synchronously with a topmost scan line within the microdisplay to coincide with the polarity inversion for the adjoining pixels on the topmost scan line within the display area; wherein the polarity of the dark ring down metal changes from positive to negative synchronously with a bottommost scan line within the microdisplay to coincide with the polarity inversion for the adjoining pixels on the bottommost scan line within the display area; and wherein the polarity of the dark ring down metal does not change from positive to negative synchronously with the change from positive to negative of the polarity of the dark ring up metal.

2. The method according to claim 1, wherein said microdisplay is a liquid-crystal-on-silicon (LCOS) display.

3. The method according to claim 1, wherein each of said dark ring up metal and said dark ring down metal is controlled according to the polarity of the adjoining pixels within the display area and the scan direction of gate drivers for the microdisplay.

4. The method according to claim 1, wherein said dark ring up metal is disposed on a top periphery of the display area, and said dark ring down metal is disposed on a lower periphery of the display area.

5. The method according to claim 4, wherein said dark ring up metal has a reverse polarity inversion with respect to said dark ring down metal.

6. The method according to claim 1, wherein said dark ring further includes at least a side portion disposed on a side periphery of the display area.

7. The method according to claim 6, wherein said side portion has a same polarity inversion as the adjoining pixels within the display area.

8. A microdisplay, comprising:

a display area having a plurality of pixels for displaying an image during a frame period;

a dark ring surrounding the plurality of pixels of the display area, said dark ring including a dark ring up metal and a dark ring down metal, each of said dark ring up metal and dark ring down metal being electrically isolated from each other; and a logic circuit for controlling said dark ring up metal to show an all-black image during a frame period firstly, then controlling the pixels of the display area to show the image during the frame period secondly, and then controlling said dark ring down metal to show an all-black image during the frame period lastly;

wherein the polarity for each of said dark ring up metal and said dark ring down metal are adjusted in accordance with the polarity of adjoining pixels within the microdisplay and the scan direction of gate drivers to coincide with that for adjoining pixels within the display area;

wherein the polarity of the dark ring up metal changes from positive to negative synchronously with a topmost scan line within the microdisplay to coincide with the polarity inversion for the adjoining pixels on the topmost scan line within the display area; wherein the polarity of the dark ring down metal changes from positive to negative synchronously with a bottommost scan line within the microdisplay to coincide with the polarity inversion for the adjoining pixels on the bottommost scan line within the display area; and wherein the polanty of the dark ring down metal does not change from positive to negative synchronously with the change from positive to negative of the polarity of the dark ring up metal.

9. The microdisplay according to claim 8, wherein said microdisplay is a liquid-crystal-on-silicon (LCOS) display.

10. The microdisplay according to claim 8, wherein said logic circuit controls each of said dark ring up metal and said dark ring down metal according to a polarity of the adjoining pixels within the display area and a scan direction of gate drivers for the microdisplay.

11. The microdisplay according to claim 10, wherein said dark ring further includes at least a side portion disposed on a side periphery of the display area.

12. The microdisplay according to claim 11, wherein said logic circuit controls said side portion such that said side portion has a same polarity inversion as the adjoining pixels within the display area.

13. The microdisplay according to claim 11, wherein said side portion comprises redundant pixels formed in side peripherals of the display area.

14. The microdisplay according to claim 8, wherein said dark ring up metal is disposed on a top periphery of the display area, and said dark ring down metal is disposed on a lower periphery of the display area.

15. The microdisplay according to claim 8, wherein said logic circuit controls said dark ring up metal and said dark ring down metal such that said dark ring up metal has a reverse polarity inversion with respect to said dark ring down metal.

16. A dark ring of a microdisplay, comprising:

a plurality of portions, formed on peripheral of a display area of the microdisplay, and comprising:

a dark ring up metal portion disposed on a top periphery of the display area; and a dark ring down metal portion disposed on a lower periphery of the display area;

wherein said dark ring up metal portion and said dark ring down metal portion are formed on a top surface of the microdisplay;

wherein each of said dark ring up metal portion and said dark ring down metal portion are electrically isolated from each other, and the polarity for each of said dark ring up metal portion and said dark ring down metal portion is adjusted in accordance with the polarity of adjoining pixels within the microdisplay and the scan direction of gate drivers to coincide with that for adjoining pixels within the microdisplay; and wherein the polarity of the dark ring up metal changes from positive to negative synchronously with a topmost scan line within the microdisplay to coincide with the polarity inversion for the adjoining pixels on the topmost scan line within the display area; wherein the polarity of the dark ring down metal changes from positive to negative synchronously with a bottommost scan line within the microdisplay to coincide with the polarity inversion for the adjoining pixels on the bottommost scan line within the display area; and wherein the polarity of the dark ring down metal does not change from positive to negative synchronously with the change from positive to negative of the polarity of the dark ring up metal.

17. The dark ring according to claim 16, wherein said microdisplay is a liquid-crystal-on-silicon (LCOS) display.

18. The dark ring according to claim 16, wherein said portions further includes at least a side portion disposed on a side periphery of the display area, wherein said side portion comprises redundant pixels formed in side peripherals of the display area.

* * * * *